US006549391B1

(12) United States Patent
Bisson

(10) Patent No.: US 6,549,391 B1
(45) Date of Patent: Apr. 15, 2003

(54) SAFETY FOOTWEAR

(75) Inventor: Michel Bisson, Blainville (CA)

(73) Assignee: STC Footwear Inc., Quebec (CA)

( * ) Notice: Subject to any disclaimer, the term of this patent is extended or adjusted under 35 U.S.C. 154(b) by 213 days.

(21) Appl. No.: 09/671,138

(22) Filed: Sep. 28, 2000

(51) Int. Cl.[7] ..... H05F 3/00
(52) U.S. Cl. ..... 361/223; 361/224
(58) Field of Search ..... 361/223, 224, 361/220

(56) References Cited

U.S. PATENT DOCUMENTS 2,712,098 A * 6/1955 Legge ..... 361/224
2,712,099 A 6/1955 Legge
4,366,630 A 1/1983 Bloom
4,551,930 A * 11/1985 Graham et al. ..... 36/30
4,654,983 A * 4/1987 Graham et al. ..... 36/30
4,674,204 A * 6/1987 Sullivan et al. ..... 36/44
4,735,195 A * 4/1988 Blum ..... 128/25
4,785,371 A 11/1988 Edwards
6,421,222 B1 * 7/2002 Maritz et al. ..... 361/224

OTHER PUBLICATIONS

D. Fink and J. Carrol (Ed), Standard Handbook for Electrical Engineers, McGraw–Hill Co., 10$^{th}$ Edition, 1974, pp. 4–85–4–87.*

* cited by examiner

*Primary Examiner*—Brian Sircus
*Assistant Examiner*—Z Kitov
(74) *Attorney, Agent, or Firm*—Diller, Ramik & Wight

(57) ABSTRACT

An electrostatic dissipative footwear comprises a conductive insole and a conductive outsole spaced by a non-conductive mid sole. An electronic device extends through the mid sole for connecting the insole and the outsole in electrically conductive relationship. The electronic device includes a resistor for precisely controlling current flow between the insole and the outsole, and an active electrical device, such as a fuse, for protecting the wearer against electrical shocks.

16 Claims, 1 Drawing Sheet

SAFETY FOOTWEAR

BACKGROUND OF THE INVENTION

1. Field of the Invention

The present invention relates to footwear and, more particularly, to a safety footwear which is adapted to dissipate electrostatic charges while at the same time protecting the wearer against electric shocks.

2. Description of the Prior Art

It is known to wear static dissipative shoes, for instance, to prevent electrostatic charges build up upon the body and clothing from being discharged to an electrostatic sensitive device being handled. Such static dissipative shoes are widely used in the electronic and computer industries to prevent damaging of electronic components, such as integrated circuits, by electrical discharges.

U.S. Pat. Nos. 4,366,630 and 4,785,371 respectively issued on Jan. 4, 1983 and Nov. 15, 1988 to Bloom and Edwards both disclose an electrostatically dissipating shoe having a composite sole including a conductive insole and a conductive outsole of rubber or plastic materials doped with an electrically conductive substance and connected together in electrically conductive relationship. U.S. Pat. No. 4,785,371 also teaches that the overall resistance across the composite sole should be in a range of about $10^6$ to $10^8$ ohms to not expose the wearer to the undue risk of injury from electrical contact, as would conventional conductive footwear exhibiting an overall resistance from zero to about $10^4$ ohms.

U.S. Pat. No. 2,712,099 issued on Feb. 23, 1952 to Legge discloses a footwear having metallic grounding members for conducting electrostatic charges from the body of the wearer to the ground. Resistors are provided as safety device to prevent the passage of a current of high amperage from the grounding members to the wearer's body.

Although the electrostatically dissipating shoes described in the above mentioned patents are effective, it has been found that there is a need for a new electrostatically dissipating footwear having a relatively low electrical resistance between the wearer's foot and ground, while still providing protection against electrical shocks.

SUMMARY OF THE INVENTION

It is therefore an aim of the present invention to provide a composite sole for a safety footwear which is, adapted to dissipate electrostatic charges while at the same time protecting the wearer against potential electric shocks.

It is also an aim of the present invention to provide a safety footwear which is comfortable to wear.

It is a further aim of the present invention to provide an electrostatically dissipating sole having a relatively low electric resistance.

It is still a further aim of the present invention to provide a new method of manufacturing an electrostatically dissipating sole for a safety footwear.

Therefore, in accordance with the present invention, there is provided a composite sole for use in a safety footwear, comprising an insole and an outsole, said insole and said outsole being at least partly made of electrically-conducting material, an insulator provided between said insole and said outsole, and an electronic device integrated between said insole and said outsole for dynamically controlling current flow therebetween, said electronic device including a resistor for setting the electrical resistance of an electrically conductive path define by said insole, said outsole and said electronic device; and a microfuse for protecting the wearer against electrical shocks, wherein said microfuse includes a fusible wire having a cross-sectional area smaller or equal to about $1\times10^{-11}$ $m^2$, said fusible wire being adapted to melt at a predetermined amperage to break said electrically conductive path, thereby protecting the wearer against electrical shocks.

In accordance with a further general aspect of the present invention, there is provided a composite sole for use in an electrostatic dissipative footwear, comprising an insole and an outsole spaced by a mid sole, said insole and said outsole being at least partly made of electrically-conducting material, whereas said mid sole is made of a substantially non-conductive material, and an electronic device extending through said mid sole for connecting said insole and said outsole in electrically conductive relationship, said electronic device including a resistor for controlling current flow between said insole and said outsole, and a fuse for protecting the wearer against electrical shocks, wherein said fuse is embedded in said mid sole which acts therefor as an insulator.

In accordance with a further general aspect of the present invention there is provided a method of manufacturing an electrostatically dissipating sole for a safety footwear, comprising the steps of: providing a conductive insole and a conductive outsole, providing an electronic device in a free space between said insole and said outsole for controlling current flow therebetween, connecting said insole and said outsole in electrically conductive relationship with said electronic device, and structurally joining said insole to said outsole by injecting a substantially non-conductive material in said free space to form a mid sole between said insole and said outsole with said electronic device at least partly embedded in said mid sole.

BRIEF DESCRIPTION OF THE DRAWINGS

Having thus generally described the nature of the invention, reference will now be made to the accompanying drawing, showing by way of illustration a preferred embodiment thereof, and in which.

DESCRIPTION OF THE PREFERRED EMBODIMENTS

Figure 1:
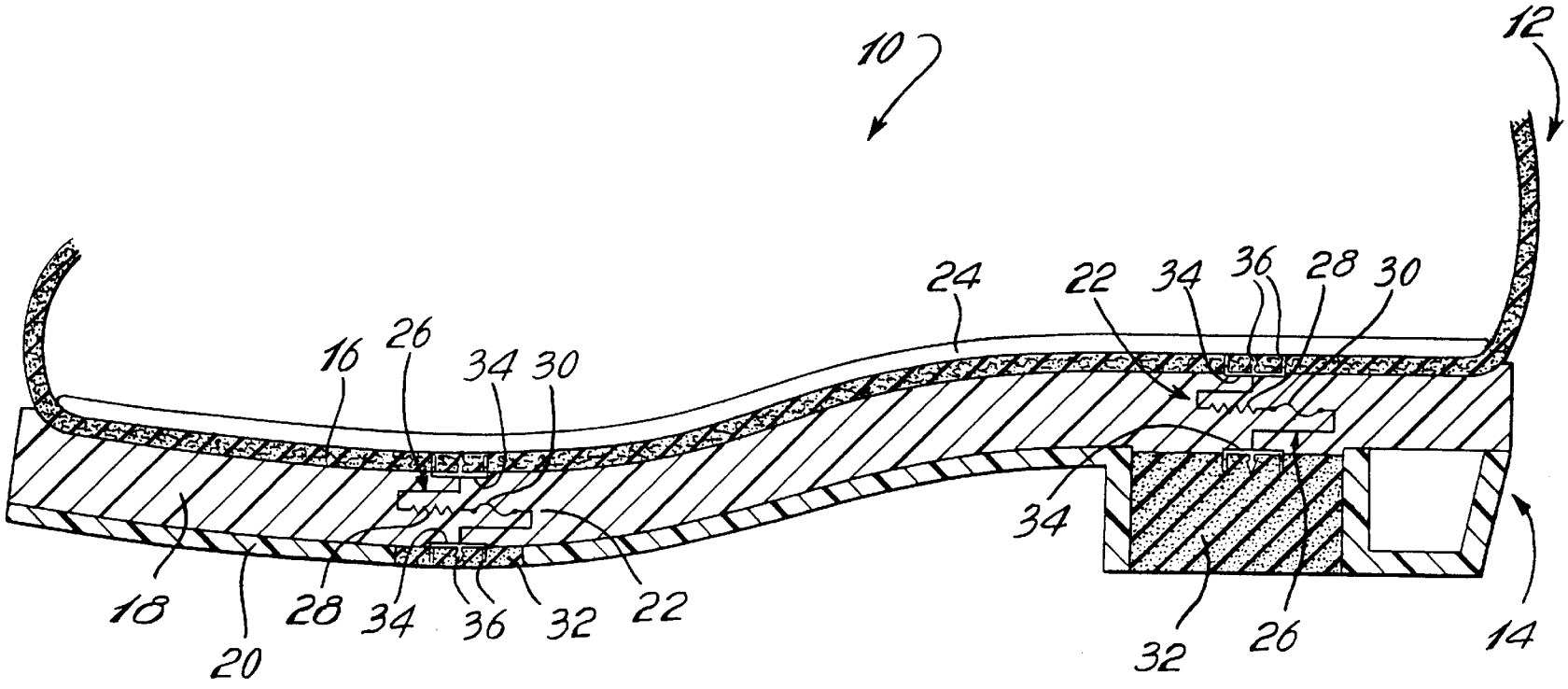
FIG. 1 is a longitudinal cross-sectional view of a safety footwear in accordance with a first embodiment of the present invention.

Now referring to FIG. 1, a safety footwear embodying the elements of the present invention and generally designated by numeral 10 will be described.

More particularly, the safety footwear 10 includes an upper 12 secured to a composite sole 14. The composite sole 14 includes an electrically conductive insole 16, an electrically insulating mid sole 18, an electrically conductive outsole 20, and an electronic device 22 embedded in the mid sole 18 for dynamically controlling the electric flow between the insole sole 16 and the outsole 20.

Provided within the safety footwear 10 and overlying the insole 16 is a removable foot bead 24 made of a conductive material, such as a woven material with conductive fibers. The removable foot bead 24 has a resistance of about $10^5$ ohms or less.

The inner sole 16 forms the bottom portion of the upper 12 and is typically made of a conducting fiberboard material having a resistance of about $10^5$ ohms or less.

According to the illustrated embodiment, the electronic device 22 defines with the insole 16 and the outsole 20 a pair of electrically conductive paths 26 for dissipating electrostatic charges from the feet of the wearer to the ground. The resistance of each path 26 is precisely set by a resistor 28 forming part of the device 22. Each resistor 28 has a precise resistance selected in a range of about 0 to $10^6$ ohms. It is understood that the resistance of the removable foot bead 24, the insole 16 and the outsole 20 must be less than that of the resistors 28 to ensure that the overall resistance of the electrically conductive paths 26 be limited by the resistors 28 and, thus, set thereby. As opposed to conventional conductive soles solely constructed of doped rubber or plastic materials, the resistors 28 advantageously allows to precisely set the effective resistance of the footwear between the wearer's feet and the ground.

A microfuse 30 is inserted in each electrically conductive path 26 to prevent the passage of a current of high amperage from the outsole 20 to the insole 16 in order to protect the wearer against electrical shocks. The provision of such microfuse 30 advantageously allows to reduce the effective resistance of the safety footwear 10 between the wearer feet and the ground, thereby increasing the overall dissipating capacity of the safety footwear 10 and that without exposing the wearer to the undue risk of electrical shocks.

According to Canadian Standards (CSA), a person should not be exposed to a current exceeding 1 mA for a voltage of 18 kV. Commonly available safety fuses do not meet these standards for a circuit having a resistance of about $10^6$ ohms or less. Applicant has found that an appropriate microfuse could be made for this particular application by using the techniques developed for manufacturing integrated circuits. For instance, thermal evaporation, e-beam or sputtering techniques could be used to obtain a length of fusible wire having the required dimensions to ensure melting thereof in the event that the current passing through the wire increases beyond 1 mA. According to a preferred embodiment of the present invention, each microfuse 30 could consist of an aluminum or lead wire having a maximum cross-sectional area of about $1\times10^{-11}$ $m^2$.

Each microfuse 30 is connected to a ground engaging plug 32 forming part of the outsole 20. One plug 32 could be provided at the heel region of the outsole 20 and the other one at the forepart region thereof. The ground engaging plugs 32 are made of a conductive material having a resistance of $10^4$ to $10^6$ ohms. For instance, the plugs 32 could be made of a rubber material containing an electrically conductive substance. The outsole 20 is preferably molded from a high density polyurethane having a resistance in a range of about $10^7$ to $10^{11}$ ohms.

Conductive washers 34 having sharp teeth 36 protruding at right angles from one side thereof can be used to anchor the resistors 28 and the microfuses 30 into the insole 16 and the ground engaging plugs 32. Alternatively, a conductive adhesive could be used.

The insole 16 and the outsole 20 are structurally joined by the mid sole 18 which is formed by injecting low density polyurethane in the free space between the prefabricated insole 16 and outsole 20. A conductive adhesive is used to secure the insole 16 to the mid sole 18. The mid sole has a resistance in a range of about $10^8$ to $10^{11}$ ohms and, thus, acts as an insulating cartridge for the microfuses 30 which are completely embedded therein.

The use of a two density injection molding process to form the mid sole 18 and the outsole 20 allows to obtain a composite sole which is flexible and of a relatively light-weight construction.

During the manufacturing process of the safety footwear 10, the outsole 20 is first molded and the insole 16 fabricated with the upper 12 using known techniques. Then, the electric circuits formed by the resistors 28 and the microfuses 30 are inserted between the insole 16 and the outsole 20 and connected thereto in electrically conductive relationship. Thereafter, the insole 16 and the outsole 20 are maintained in relatively close proximity in a mold and low density polyurethane is then injected in the free space between the insole 16 and the outsole 20 for forming the mid sole 18 in which the resistors 28 and the microfuses 30 are embedded.

It is noted that according to a further embodiment of the present invention the outsole could be solely molded from a rubber material containing electrically conductive substance. This would provide a continuous grounding surface of conductive material but would increase the weight of the safety shoe 10.

According to further embodiments of the present invention which are not illustrated, the fuse could consist of a reversed biased diode or, alternatively, of an assembly of transistors.

According to another embodiment of the present invention, the plugs 32 could be electrically connected together with a single resistor and a single fuse completing the electric circuit between the insole and the outsole.

What is claimed is:

1. A composite sole for use in a safety footwear, comprising an insole and an outsole, said insole and said outsole being at least partly made of electrically-conducting material, an insulator between said insole and said outsole, and an electronic device integrated between said insole and said outsole for dynamically controlling current flow therebetween, said electronic device including a resistor for setting the electrical resistance of an electrically conductive path define by said insole, said outsole and said electronic device; and a microfuse for protecting the wearer against electrical shocks, wherein said insulator is molded about said electronic device with said electrical resistance fixedly set in the surrounding insulating material.

2. A composite sole as defined in claim 1, wherein said insulator includes a mid sole placed between said insole and said outsole, and wherein said microfuse is embedded in said mid sole, said mid sole acting as an insulating cartridge for said microfuse.

3. A composite sole as defined in claim 2, wherein said mid sole is made of a material having a resistance which is higher than that of said insole, said outsole and said electronic device.

4. A composite sole as defined in claim 1, wherein said fusible wire is made of aluminum.

5. A composite sole as defined in claim 1, wherein said electronic device is embedded in an insulating mid sole formed between said insole and said outsole.

6. A composite sole as defined in claim 2, wherein said electronic device is anchored at a first end thereof in said insole and at a second end thereof in said outsole, said insole and said outsole having a resistance which is smaller than that of said resistor.

7. A composite sole as defined in claim 1, wherein said outsole is provided with at least one conductive grounding engaging plug connected in electrically conductive relationship with said electronic device for discharging static charges from the wearer to the ground.

8. A composite sole as defined in claim 2, wherein said mid sole and said outsole are respectively molded from low density and high density polyurethane materials.

9. A composite sole for use in an electrostatic dissipative footwear, comprising an insole and an outsole spaced by a mid sole, said insole and said outsole being at least partly made of electrically-conducting material, whereas said mid sole is made of a substantially non-conductive material, and an electronic device extending through said mid sole for connecting said insole and said outsole in electrically conductive relationship, said electronic device including a resistor for controlling current flow between said insole and said outsole, wherein said resistor is embedded in said mid sole which acts therefor as an insulator, said resistor being in immediate contact on all sides with the material of said mid sole.

10. A composite sole as defined in claim 9, wherein said electronic device further includes a fuse, said fuse including a fusible wire having a maximum cross-sectional area of about $1\times10^{-11}$ $m^2$, said fusible wire being adapted to melt at a predetermined amperage.

11. A composite sole as defined in claim 10, wherein said fusible wire is made of aluminum.

12. A method of manufacturing an electrostatically dissipating sole for a safety footwear, comprising the steps of: providing a conductive insole and a conductive outsole, providing an electronic device in a free space between said insole and said outsole for controlling current flow therebetween, connecting said insole and said outsole in electrically conductive relationship with said electronic device, and structurally joining said insole to said outsole by injecting a substantially non-conductive material in said free space to form a mid sole between said insole and said outsole with said electronic device at least partly embedded in said mid sole.

13. A method as defined in claim 12, wherein the step of structurally joining said insole to said outsole includes the steps of placing said insole and said outsole in a mold with said electronic device extending between said insole and said outsole, and then injecting said substantially non-conductive material in said mold between said insole and said outsole.

14. A method as defined in claim 12, wherein the step of connecting said insole and said outsole in electrically conductive relationship with said electronic device is effected by anchoring a first end of said electronic device in said insole and a second opposed end thereof in said outsole.

15. A method as defined in claim 12, wherein the step of providing said outsole includes the steps of inserting at least one conductive ground engaging plug into a pre-molded outsole.

16. A composite sole for use in an electrostatic dissipative footwear, comprising an isole and an outsole spaced by a mid sole, said insole and said outsole being at least partly made of electrically-conducting material, whereas said mid sole is made of a substantially non-conductive material, and an electronic device electrically connected to said insole and said outsole for controlling current flow therebetween, said mid sole being molded about said electronic device so that the electronic device is set in said mid sole with the space surrounding the electronic device completely filled with material.

* * * * *